US006981599B2

(12) United States Patent
Grau et al.

(10) Patent No.: US 6,981,599 B2
(45) Date of Patent: Jan. 3, 2006

(54) HIGH CAPACITY SHEAR MECHANISM

(75) Inventors: Curtiss A. Grau, Duncan, SC (US); Howard R. Sommerfeld, Oak Forest, IL (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 10/675,538

(22) Filed: Sep. 30, 2003

(65) Prior Publication Data

US 2005/0029215 A1 Feb. 10, 2005

Related U.S. Application Data

(60) Provisional application No. 60/493,754, filed on Aug. 8, 2003.

(51) Int. Cl.
*B61G 1/00* (2006.01)

(52) U.S. Cl. ..... 213/62 R; 213/50; 213/69

(58) Field of Classification Search ..... 213/1 R, 213/50, 61, 62 R, 64, 67 R, 69; 403/2; 411/389
See application file for complete search history.

(56) References Cited

U.S. PATENT DOCUMENTS

| | | | | | |
|---|---|---|---|---|---|
| 3,247,977 | A | * | 4/1966 | Dilg | 213/9 |
| 3,351,214 | A | * | 11/1967 | Herbert | 213/9 |
| 3,515,288 | A | | 6/1970 | Frill et al. | |
| 3,610,434 | A | | 10/1971 | Herbert | |
| 6,056,471 | A | * | 5/2000 | Dinitz | 403/2 |
| 6,321,922 | B1 | * | 11/2001 | Rumsey et al. | 213/7 |
| 6,499,613 | B1 | * | 12/2002 | Grau et al. | 213/7 |

* cited by examiner

*Primary Examiner*—Mark T. Le
(74) *Attorney, Agent, or Firm*—The Webb Law Firm

(57) ABSTRACT

An emergency release mechanism for a railway drawbar, which reduces stress in two piece machine bolts inserts in emergency release mechanisms, includes a two sided threaded stud which screws into a release rail using one of the threaded stud ends, passes through a drawbar body, and is secured to the drawbar body by a nut screwed onto the other threaded stud end.

10 Claims, 1 Drawing Sheet

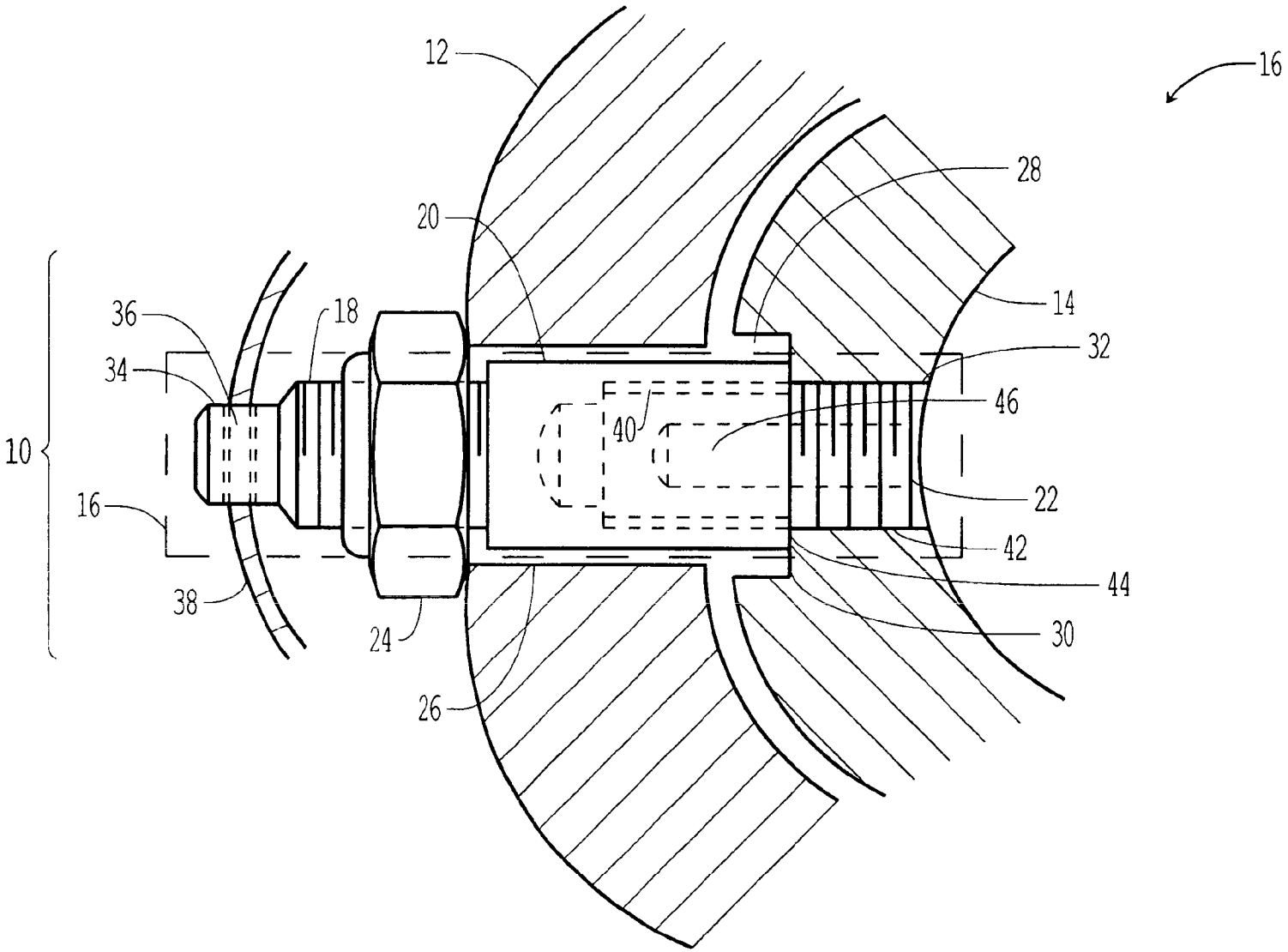
16
28
14
32
46
22
42
44
30
40
12
20
26
24
18
36
34
38
16
10

HIGH CAPACITY SHEAR MECHANISM

CROSS-REFERENCE TO RELATED APPLICATIONS

This application claims the benefit of U.S. Provisional Application No. 60/493,754, filed Aug. 8, 2003, and which is incorporated herein by reference.

BACKGROUND OF THE INVENTION

1. Field of the Invention

This invention relates to railway drawbars and, more specifically, to shear mechanisms for railway drawbars.

2. Description of Related Art

Prior art emergency release mechanisms, such as the shear bolts shown in U.S. Pat. No. 6,499,613 to Grau et al., are subject to premature failure. These premature failures can be expensive to repair and can cause inconvenience.

Therefore, it can be appreciated that an emergency release mechanism which lessens the number of premature failures of emergency release mechanisms is desirable.

BRIEF SUMMARY OF THE INVENTION

In one aspect the present invention generally provides an emergency release mechanism for a railway drawbar having a fastener stud, the fastener stud passing through an opening in a drawbar body, and a body of the fastener stud secured to a release rail. A fastener is secured to one end of the fastener stud to hold the release rail proximate to the drawbar body.

In a further aspect of this invention a method of attaching a shear mechanism to a railroad drawbar includes securing a body of a stud to a release rail, passing the stud through an opening in a drawbar body, and securing a fastener to one end of the stud to thereby draw together the release rail and the drawbar body such that they are proximate to each other.

OBJECTS OF THE INVENTION

It is, therefore, one of the primary objects of the present invention to provide an emergency release mechanism which reduces the number of premature failures of emergency release mechanisms.

Another object, of the present invention, is to provide an emergency release mechanism which lessens the amount of fatigue in the emergency release mechanism during normal operation of the drawbar.

DESCRIPTION OF THE DRAWING

The aforementioned and other features, characteristics, advantages, and the invention in general will be better understood from the following more detailed description taken in conjunction with the accompanying drawing.

The sole FIGURE is a cross sectional view of an emergency release mechanism according to the present invention.

It will be appreciated that for purposes of clarity and where deemed appropriate, that the various elements in the drawings have not necessarily been drawn to scale in order to better show the features of the invention.

DETAILED DESCRIPTION OF THE PREFERRED EMBODIMENT

Turning now to the drawing, the sole FIGURE shows an emergency release mechanism 10 together with a drawbar body 12 and a release rail 14 and are shown generally as 16.

The emergency release mechanism 10, in the preferred embodiment, consists of a fastener stud such as a two sided threaded stud 16, having a first threaded end 18, a cylindrical body 20 and a second threaded end 22, together with a fastener such as a lock nut 24, a through hole 26 in the drawbar body 12, a recess 28 having a machined surface 30 in the release rail 14, an aperture such as a tapped opening such as a threaded hole 32 in the release rail 14, the rim of which is located in the recess 28, and a chamfered dowel extension 34 of the first threaded end 18 having a hole 36 there through. A retaining wire 38 passes through the hole 36.

The dowel extension 34 is flattened such that a wrench interface is formed so that a wrench can be used on the dowel extension 34 to screw the second threaded end 22 securely into the release rail 14.

Prior to the present invention the drawbar body and the release rail were held together by a two piece machine bolt insert through the drawbar body into threads in the release rail. Because of manufacturing tolerances, the drawbar body and the release rail were not pulled tightly together at the site of the two piece machine bolt insert, but rather a space was present between the two piece machine bolt insert and the release rail. This space caused a potential bending moment on the threaded portion of the two piece machine bolt insert of the mechanism during a buff (compressive loading) application to the drawbar. This bending moment could cause premature failures of the emergency release mechanism in the drawbar.

The emergency release mechanism 10 of the present invention eliminates this space in the sense that there is a solid contact between the release mechanism 10 and the release rail 14 via the stud 16 such that the drawbar body 12 and the release rail 14 are held proximate to each other. In the assembly of the drawbar, in the preferred embodiment, the stud 16 is placed through the through hole 26 of the drawbar body 12 and is tightened into the threaded hole 32 in the recess 28 in the release rail 14. The lock nut 24 is then attached and tightened to draw together the drawbar body 12 and the release rail 14 such that they are proximate each other. Any lateral or vertical forces applied to the drawbar body 12 with respect to the release rail 14 are withstood mainly by the body 20 and the flat machined surface 30 of the recess 28 which is engageable with the surface 44 of the body 20. In the prior art emergency release mechanisms these forces were withstood solely by the threaded portion of the two piece machine bolt insert which produced fatigue in the two piece machine bolt insert.

With the space eliminated, the bending moment on the threaded portion of the two piece machine bolt insert of the prior art mechanism during a buff application to the drawbar is no longer present. This improvement lowers the bending stress and adds increased fatigue life to the emergency release mechanism 10 and reduces the rate of premature failure.

The width of the recess 28 is made wide enough so that it doesn't interfere with the shearing of the stud 16. That is, the maximum width of the body 12 of the two sided threaded stud 16 is less than the maximum width of the recess 28. Also, in the preferred embodiment, the two sided threaded stud 16 is manufactured by forming a one sided or single threaded stud consisting of the body 16 and the first threaded end 18, then forming threads 40 in the end of the stud 16 opposite the threaded end and screwing into the threads 40 a threaded bar 42 to form the two sided threaded stud 16.

A cutout 46 in the center of a portion of the second threaded end 22 is formed for regulating the amount of shear force that the second threaded end 22 can withstand before it shears.

Testing of the emergency release mechanism 10 has shown considerable improvement in the fatigue life of the mechanism 10 without changing the required intent of the shear capabilities for an emergency release mechanism.

Although the invention has been described in part by making detailed reference to a certain specific embodiment, such detail is intended to be, and will be understood to be, instructional rather than restrictive. It will be appreciated by those skilled in the art that many variations may be made on the structure and mode of operation without departing from the spirit and scope of the invention as disclosed in the teachings contained herein.

We claim:

1. An emergency release mechanism for a railway drawbar comprising:

a) a stud threaded at first and second ends and having an unthreaded intermediate body having a flat radial surface adjacent the first threaded end, said stud passing through an opening in a drawbar body with said first threaded end screwed into a release rail; and b) a fastener screwed to a second threaded end to hold said release rail proximate to said drawbar body, wherein a recess is formed in said release rail around a threaded opening in said release rail to receive said first threaded end of said stud, said recess having a flat surface being wider than a width of said intermediate unthreaded body of said stud and being abuttingly engageable with the flat radial surface of the body of said threaded stud.

2. The emergency release mechanism, according to claim 1, wherein said recess has a width wider than any width of said body of said stud.

3. The emergency release mechanism, according to claim 1, wherein said fastener is a lock nut.

4. The emergency release mechanism, according to claim 1, wherein said stud comprises a stud internally threaded at the second end and a threaded bar screwed into said internally threaded end of said stud.

5. The emergency release mechanism, according to claim 1, wherein said second threaded end includes a dowel extension having a wrench interface for attaching a wrench to said dowel extension during assembly of said emergency release mechanism.

6. The emergency release mechanism, according to claim 5, wherein said dowel extension includes a through opening for receiving a retaining wire.

7. An emergency release mechanism for a railway drawbar comprising:

a) a threaded fastener stud having opposed threaded ends and an unthreaded intermediate body portion, said body portion having a flat radial end, said fastener stud passing through an opening in a drawbar body, and said flat radial end surface of said body portion of said fastener stud abuttingly engageable and secured to a release rail, wherein a recess having a flat surface is formed in said release rail with an opening in said recess to receive said flat radial end surface of said fastener stud, said recess being wider than the body portion of said stud; and b) a fastener secured to one end of said fastener stud to hold said release rail proximate to said drawbar body.

8. The emergency release mechanism, according to claim 7, wherein said body of said fastener stud is secured to said release rail by a first threaded portion of said fastener stud, said first threaded portion having been screwed into a tapped opening in said release rail.

9. The emergency release mechanism, according to claim 8, wherein said body of said fastener stud has a flat bottom such that said recess surface is engageable with said flat bottom of said fastener stud.

10. The emergency release mechanism, according to claim 7, wherein said fastener secured to one end of said fastener stud is a nut having been screwed onto a second threaded end of said fastener stud.

* * * * *

UNITED STATES PATENT AND TRADEMARK OFFICE

CERTIFICATE OF CORRECTION

PATENT NO. : 6,981,599 B2
APPLICATION NO. : 10/675538
DATED : January 3, 2006
INVENTOR(S) : Grau et al.

It is certified that error appears in the above-identified patent and that said Letters Patent is hereby corrected as shown below:

Face of the Patent, See Item (56) References Cited, add the following:

-- FOREIGN PATENT DOCUMENTS
EP 112 7769 08/2001 --

Column 3, Line 23, Claim 1, "around a threaded" should read
-- around said threaded --

Signed and Sealed this

First Day of August, 2006

JON W. DUDAS
*Director of the United States Patent and Trademark Office*